US006527572B2

(12) United States Patent
Jou

(10) Patent No.: US 6,527,572 B2
(45) Date of Patent: Mar. 4, 2003

(54) POSITIONING MECHANISM FOR AN ELECTRICAL CONNECTOR

(75) Inventor: Chang Jen Jou, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/909,633

(22) Filed: Jul. 19, 2001

(65) Prior Publication Data

US 2002/0048982 A1 Apr. 25, 2002

(30) Foreign Application Priority Data

Oct. 20, 2000 (TW) ..... 89122143

(51) Int. Cl.[7] ..... H01R 13/64
(52) U.S. Cl. ..... 439/248; 439/247; 439/65
(58) Field of Search ..... 439/247, 248, 439/67, 289, 86, 65

(56) References Cited

U.S. PATENT DOCUMENTS 6,062,872 A * 5/2000 Strange et al. ..... 439/248
6,065,988 A * 5/2000 Kubota ..... 439/248
6,346,007 B2 * 2/2002 Yokoi ..... 439/248
6,358,095 B1 * 3/2002 Tischner ..... 439/248

* cited by examiner

*Primary Examiner*—Hien Vu
(74) *Attorney, Agent, or Firm*—Wei Te Chung

(57) ABSTRACT

A positioning mechanism is provided for accurately aligning an electrical connector (90) with a complementary connector. The positioning mechanism comprises a stationary base (3) having a number of rotatable elements mounted thereon (5), a stationary cover (1) defining an opening and having a pair of downwardly projecting positioning pins (13), an intermediate plate (2) adapted for mounting the electrical connector and defining a pair of through holes (21) for engaging with the positioning pins, and a pair of resilient elements (4) compressed between the intermediate plate and the base. When the electrical connector engages with the complementary connector, the intermediate plate moves downwardly against the resilient elements until a bottom surface of the intermediate plate touches the rotatable elements, and there exists a clearance between the positioning pin and the through hole for the intermediate plate to move upon the rotatable elements in a direction parallel to the cover.

6 Claims, 6 Drawing Sheets

POSITIONING MECHANISM FOR AN ELECTRICAL CONNECTOR

BACKGROUND OF THE INVENTION

1. Field of the Invention

The present invention relates to a positioning mechanism for an electrical connector, and particularly to a positioning mechanism for an electrical connector mounted in a docking station.

2. Description of Related Art

With a miniaturization development of notebook computers, a docking station is employed to increase the number of functional devices connected with a notebook computer or to interconnect a notebook computer with peripheral devices. The docking station typically provides a high density receptacle connector functioning as an exterior interface to connect with a mating plug connector mounted on the notebook computer, thereby establishing an electrical connection between the notebook computer and the docking station. In use, the notebook computer is connected to the docking station by connecting the plug connector with the receptacle connector. However, the inevitable mating tolerance between the notebook computer and the docking station may result in a misalignment between the plug connector and the receptacle connector, thus making the engagement between the plug connector and the receptacle connector incorrect and difficult. As a result, the electrical engagement between the receptacle connector and the plug connector may be unreliable and the quality of signal transmission therebetween may be adversely affected.

Hence, a positioning mechanism for an electrical connector in a docking station is required to overcome the disadvantages of the related art.

SUMMARY OF THE INVENTION

Accordingly, the object of the present invention is to provide a positioning mechanism for an electrical connector for accurately aligning the electrical connector with a complementary connector, thereby ensuring a reliable electrical engagement therebetween.

In order to achieve the object set forth, a positioning mechanism for an electrical connector, which has a mating section, comprises a stationary base having a plurality of rotatable elements mounted thereon, a cover defining an opening and having a pair of downwardly projecting positioning pins, an intermediate plate adapted for mounting the electrical connector and defining a pair of through holes for engaging with the positioning pins, and a pair of resilient elements compressed between the intermediate plate and the base. The opening of the cover has a larger size than the mating section of the electrical connector for extension of the mating section to engage with a complementary connector.

When the electrical connector engages with the complementary connector, the resilient elements are compressed to cause the intermediate plate to move downwardly until a bottom surface of the intermediate plate touches the rotatable elements, and there exists a clearance between the positioning pin and the through hole for the intermediate plate to move upon the rotatable elements in a direction parallel to the cover, thereby aligning the electrical connector with the complementary connector and ensuring a reliable electrical connection therebetween.

Other objects, advantages and novel features of the invention will become more apparent from the following detailed description when taken in conjunction with the accompanying drawings.

DETAILED DESCRIPTION OF THE INVENTION

Figure 1:
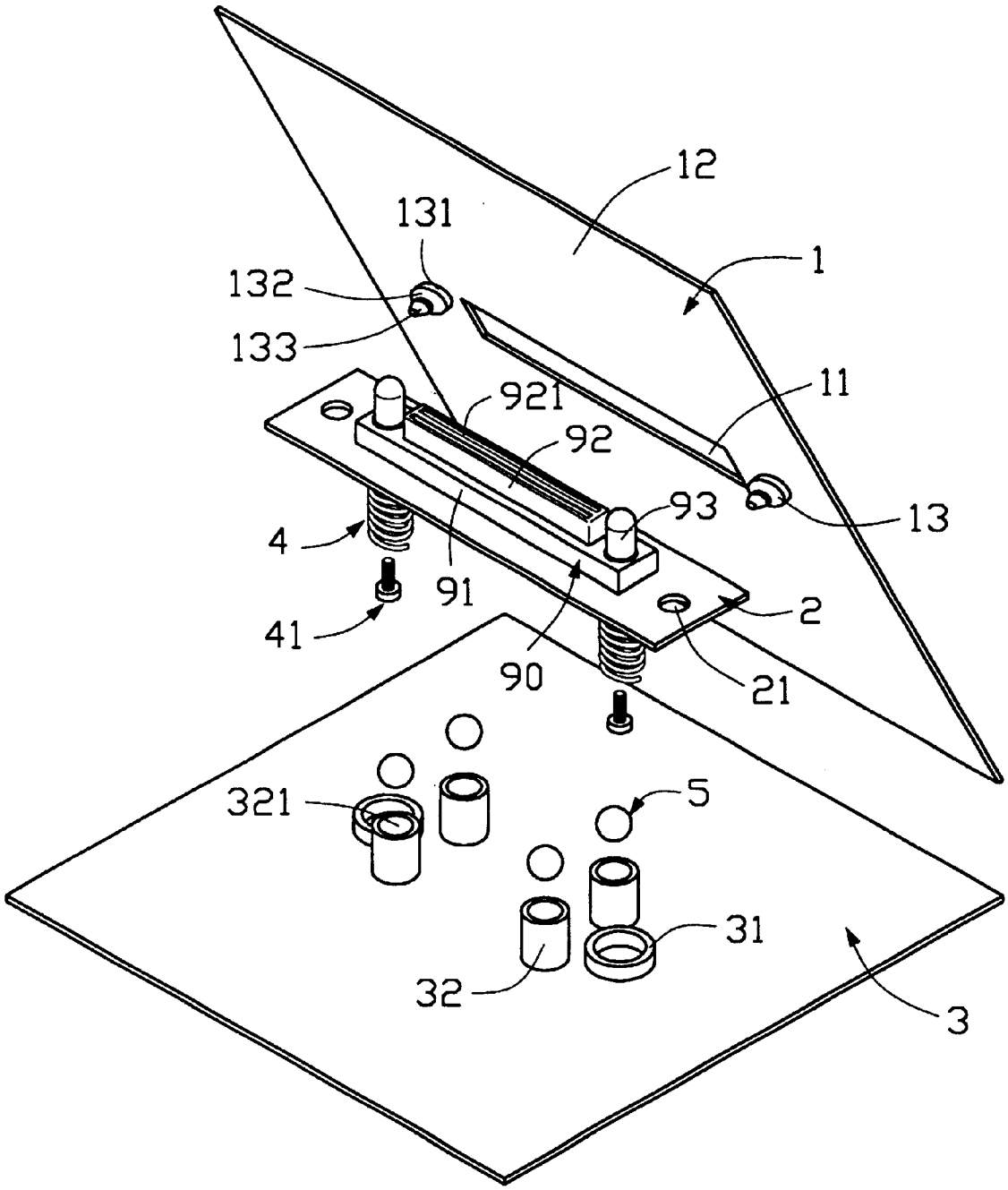
FIG. 1 is an exploded perspective view of a positioning mechanism for an electrical connector in accordance with the present invention.

Referring to FIG. 1, a positioning mechanism for an electrical connector 90 in accordance with the present invention is shown. The electrical connector 90 is mounted in a docking station (shown in part) for engaging with a complementary connector (not shown) mounted on a notebook computer (not shown). The electrical connector 90 comprises abase section 91 of a rectangular configuration, and a mating section 92 extending upwardly from the base section 91. The base section 91 has a pair of upwardly extending guide pins 93 on opposite ends of the mating section 92 for guiding the electrical connector 90 to engage with the complementary connector. The mating section 92 defines two elongated slots 921 with a plurality of contacts (not shown) retained therein, respectively.

The positioning mechanism comprises a stationary cover 1, an intermediate plate 2 adapted for mounting the electrical connector 90, a stationary base 3, a pair of resilient elements 4, and a plurality of rotatable elements 5.

The stationary cover 1 is a top panel of the docking station. In the preferred embodiment of the present invention, only a part of the top panel is shown. The cover 1 defines a rectangular opening 11 for extension of the mating section 92 and the guide pins 93 to engage with the complementary connector. A pair of positioning pins 13 extends downwardly from a bottom surface 12 of the cover 1. The positioning pins 13 are positioned on two opposite sides of the opening 11 in a longitudinal direction. Each positioning pin 13 comprises a large-dimensioned cylindrical portion 131, a small-dimensioned conical portion 133, and an intermediate portion 132 interconnecting the cylindrical portion 131 with the conical portion 133.

The intermediate plate 2 is of a rectangular configuration. In the preferred embodiment of the present invention, the intermediate plate 2 is a printed circuit board (PCB). The contacts of the electrical connector 90 extend through the base section 91 for being connected to circuits on the intermediate plate 2. The intermediate plate 2 is connected to a mother board (not shown) of the docking station via a flexible printed circuit (FPC). Thus, an electrical connection is established between the electrical connector 90 and the mother board. The intermediate plate 2 defines a pair of through holes 21 on two opposite ends of the base section 91 of the electrical connector 90 for engaging with the positioning pins 13 on the cover 1, and a pair of screw holes (not shown) extending from a bottom surface 20 (FIG. 2) thereof and into the guide pins 93 on the base section 91 of the electrical connector 90 for receiving a pair of bolts 41, respectively. The diameter of each through hole 21 is smaller than that of the cylindrical portion 131 of the positioning pin 13 but larger than the largest diameter of the conical portion 133 of the positioning pin 13.

The stationary base 3 is a bottom panel of the docking station. In the preferred embodiment of the present invention, only a part of the bottom panel is shown. The base 3 has a pair of first supporting elements 31 extending upwardly therefrom for receiving the resilient elements 4, and a plurality of second supporting elements 32 also extending upwardly therefrom for receiving the rotatable elements 5. Each first supporting element 31 is generally of a annular configuration for positioning the resilient element 4. Each second supporting element 32 is generally of a cylindrical configuration defining a depression 321 in a top surface thereof for supporting and positioning the rotatable element 5.

In the preferred embodiment of the present invention, the resilient elements 4 are a pair of springs. The rotatable elements 5 are a plurality of steel balls. Alternatively, the first supporting element 31 can also has a cylindrical shape to be received into the resilient element 4.

Figure 2:
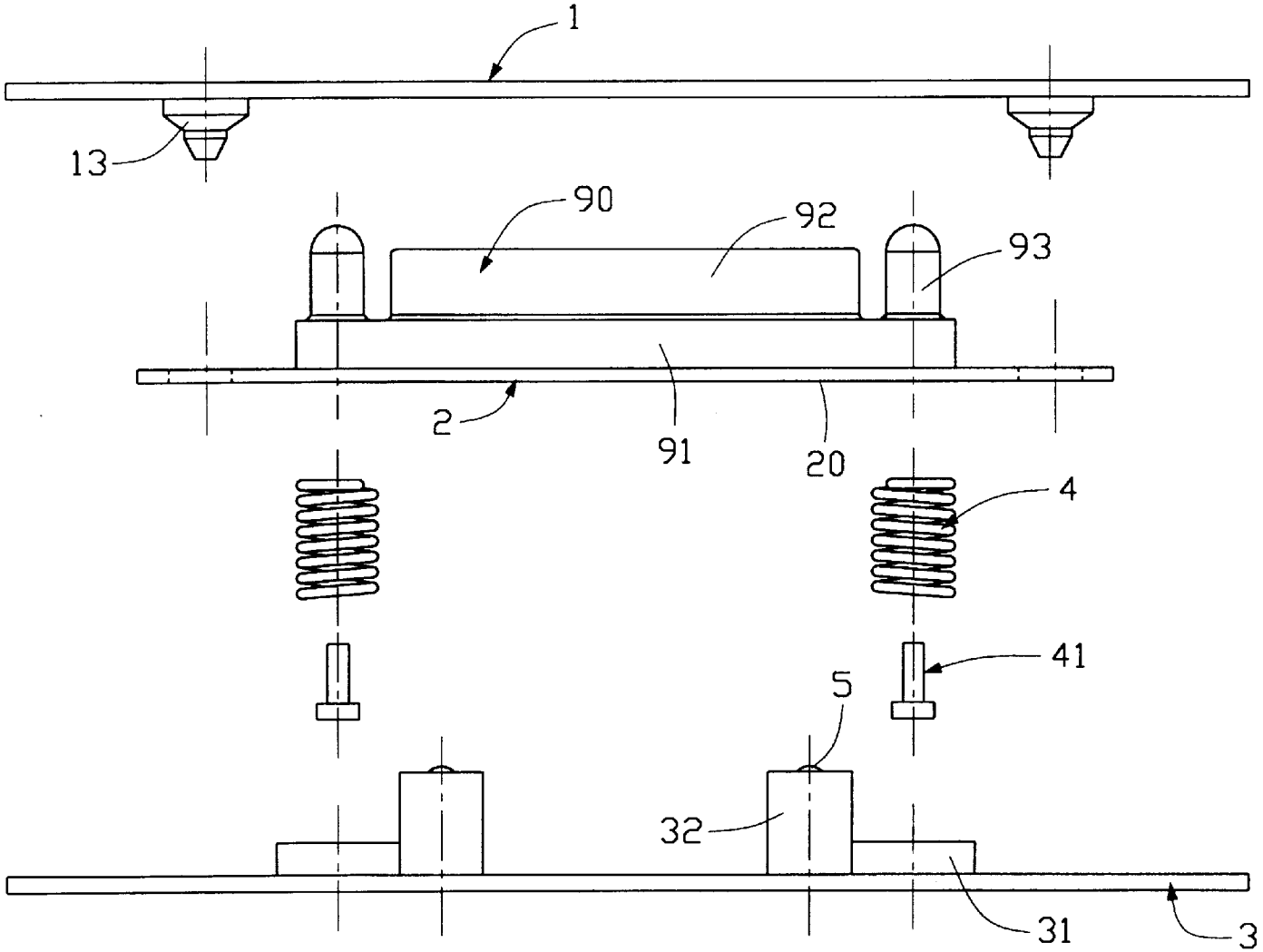
FIG. 2 is an exploded, front view of the positioning mechanism.
Figure 3:
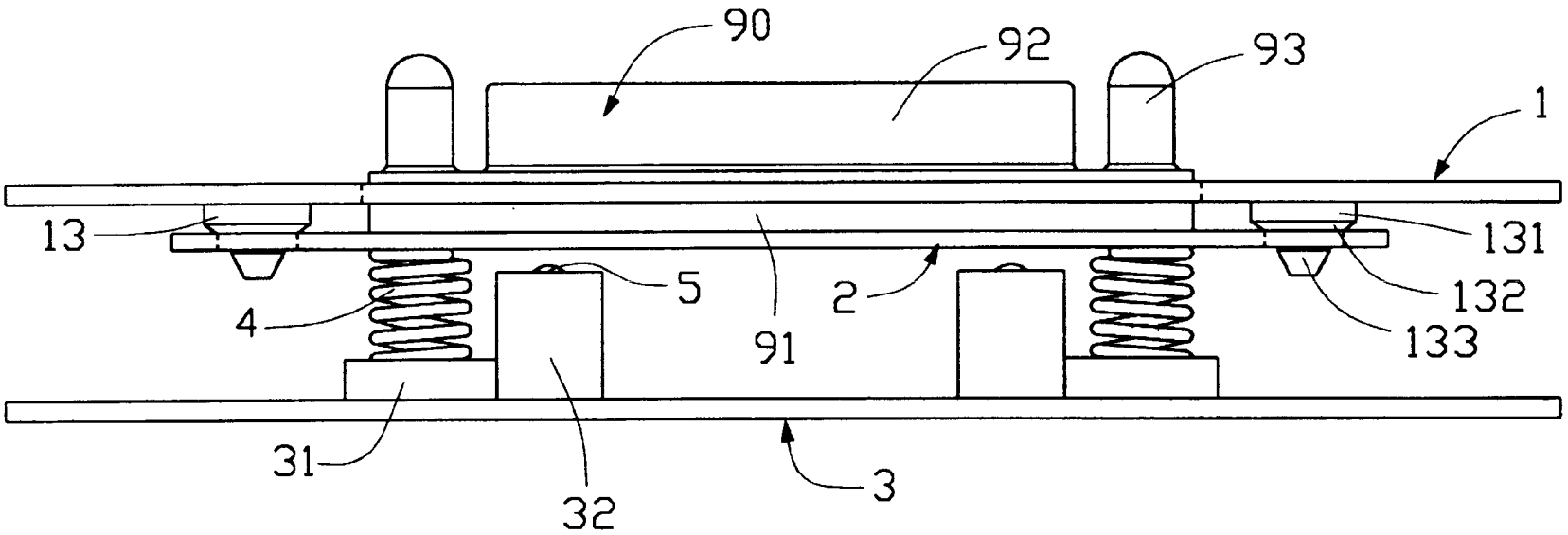
FIG. 3 is an assembled view of FIG. 2.

Further referring to FIGS. 2 and 3, in assembly, the resilient elements 4 are bolted to the bottom surface 20 of the intermediate plate 2 by the bolts 41. The rotatable elements 5 are rotatablely received in the depressions 321 of the second supporting elements 32 respectively and each slightly projects from the top surface of the second supporting element 32. Then, the intermediate plate 2 together with the electrical connector 90 and the resilient elements 4 is mounted onto the base 3. A free end of each resilient element 4 is received and retained in a corresponding first supporting element 31. Finally, the cover 1 is mounted onto the intermediate plate 2. The positioning pins 13 on the cover 1 are received in the through holes 21 of the intermediate plate 2, respectively. The mating section 92 and the guide pins 93 of the electrical connector 90, which is mounted on the intermediate plate 2, extend through the opening 11 of the cover 1 for mating with the complementary connector. Thus, the intermediate plate 2 mounting the electrical connector 90 is located between the cover 1 and the base 3 by means of resilient supporting force provided by the resilient elements 4.

Figure 4:
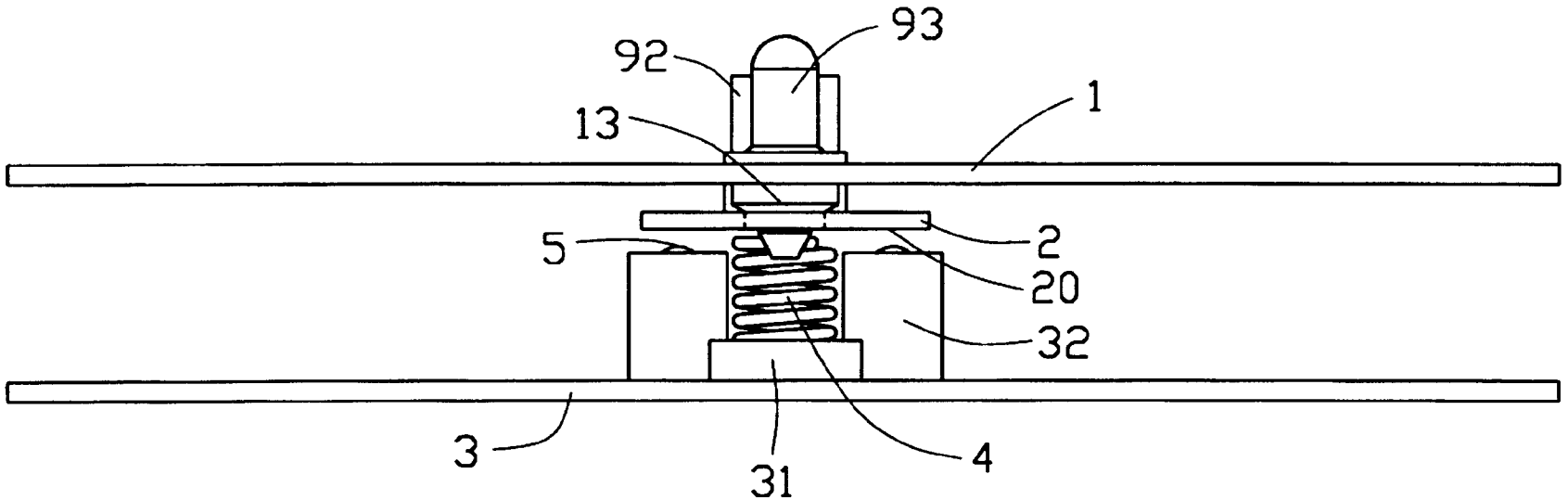
FIG. 4 is a side, assembled view of the positioning mechanism.
Figure 5:
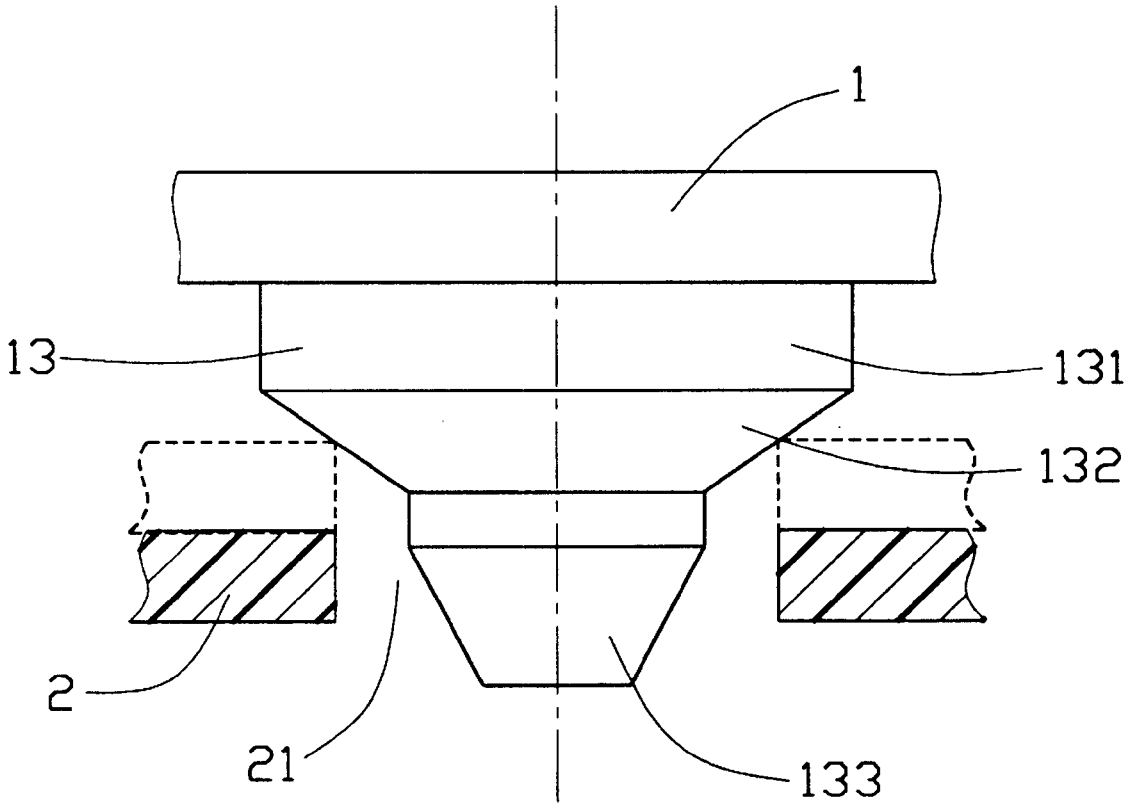
FIG. 5 is an enlarged cross-sectional view showing an intermediate plate of the positioning mechanism in two different positions.

Further referring to FIGS. 4 and 5, when the electrical connector 90 mounted on the intermediate plate 2 is disengaged with the complementary connector, the intermediate portion 132 of the positioning pin 13 abuts against the peripheral of the through hole 21 of the intermediate plate 2 which is shown in dashed lines in FIG. 5. At the same time, there exists a clearance between the bottom surface 20 of the intermediate plate 2 and the rotatable elements 5.

Figure 6:
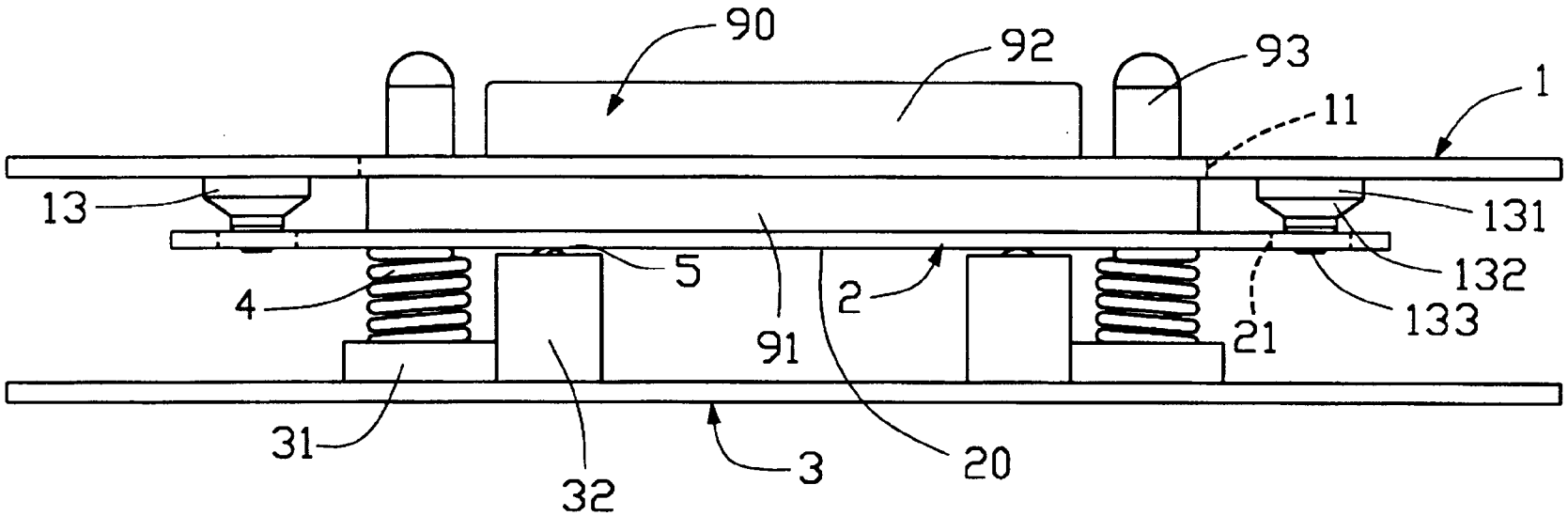
FIG. 6 is a front, assembled view of the positioning mechanism when resilient elements of the positioning mechanism are compressed.

Also referring to FIG. 6, when the complementary connector mounted on the notebook computer is engaged with the electrical connector 90 mounted on the intermediate plate 2 of tie docking station, the resilient elements 4 are compressed to cause the intermediate plate 2 to move downwardly until the bottom surface 20 of the intermediate plate 2 touches the rotatable elements 5. As the largest diameter of the conical portion 133 of the positioning pin 13 is smaller than that of the through hole 21 of the intermediate plate 2, there exists an enough clearance between the positioning pin 13 and the through hole 21. Furthermore, the opening 11 of the cover 1 has a larger size than the base section 91 of the electrical connector 90. There also exists an enough clearance between the opening 11 and the base section 91 of the electrical connector 90. Therefore, the intermediate plate 2 mounting the electrical connector 90 can move in a direction parallel to the cover 1 to compensate the mating tolerance between the electrical connector 90 and the complementary connector, thereby accurately aligning the complementary connector with the electrical connector 90 and ensuring a reliable electrical connection therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A positioning mechanism for aligning an electrical connector with a complementary connector, comprising:

a stationary base having a plurality of rotatable elements mounted thereon;

a stationary cover defining an opening and having a pair of downwardly projecting positioning pins;

an intermediate plate adapted for mounting an electrical connector and defines a pair of through holes for engaging with the positioning pins; and a pair of resilient elements compressed between the base and the intermediate plate;

wherein when the intermediate plate moves downwardly against the resilient elements with a bottom surface of the intermediate plate touches the rotatable elements, horizontal clearance exists between the positioning pin and the corresponding through hole so as to allow the intermediate plate to somewhat move, with support via the rotatable elements, in a direction parallel to the cover; wherein each positioning pin comprises a large-dimensioned cylindrical portion and a small-dimensioned conical portion, the diameter of each through hole being smaller than that of the cylindrical portion of the positioning pin but larger than a largest diameter of the conical portion of the positioning pin; wherein the base has a pair of first supporting elements for supporting the resilient elements and a plurality of second supporting elements for receiving the rotatable elements.

2. The positioning mechanism as described in claim 1, wherein each first supporting element is generally of an annular configuration for positioning a corresponding resilient element.

3. The positioning mechanism as described in claim 1, wherein each second supporting element is generally of a cylindrical configuration defining a depression in a top surface thereof for supporting and positioning a corresponding rotatable element.

4. A combination of an electrical connector and a positioning mechanism for aligning the electrical connector with a complementary connector, comprising:

an electrical connector having a base section and a mating section extending from the base section; and a positioning mechanism, the positioning mechanism comprising a stationary base having a plurality of rotatable elements mounted thereon, a stationary cover defining an opening and having a pair of downwardly projecting positioning pins, an intermediate plate adapted for mounting the electrical connector and defining a pair of through holes for engaging with the positioning pins, and a pair of resilient elements compressed between the intermediate plate and the base, the opening of the cover having a larger size than the mating section of the electrical connector for extension of the mating section to engage with a complementary connector;

wherein during engaging the electrical connector with the complementary connector, the intermediate plate moves downwardly against the resilient elements with a bottom surface of the intermediate plate touches the rotatable elements, horizontal clearance exists between the positioning pin and the corresponding through hole so as to allow the intermediate plate to somewhat move, with support via the rotatable elements, in a direction parallel to the cover; wherein each positioning pin comprises a large-dimensioned cylindrical portion and a small-dimensioned conical portion, the diameter of each through hole being smaller than that of the cylindrical portion of the positioning pin but larger than a largest diameter of the conical portion of the positioning pin; wherein the base has a pair of first supporting elements for supporting the resilient elements and a plurality of second supporting elements for receiving the rotatable elements.

5. The combination as described in claim 4, wherein each first supporting element is generally of a annular configuration for positioning a corresponding resilient element.

6. The combination as described in claim 4, wherein each second supporting element is generally of a cylindrical configuration defining a depression in a top surface thereof for supporting and positioning a corresponding rotatable element.

* * * * *